US011466699B2

(12) United States Patent
Kim et al.

(10) Patent No.: US 11,466,699 B2
(45) Date of Patent: Oct. 11, 2022

(54) FAN COWL FOR THE REDUCTION OF OSCILLATIONS OF AN IMPELLER

(71) Applicant: Robert Bosch GmbH, Stuttgart (DE)

(72) Inventors: Joonhyoung Kim, Sejong (KR); Sangyeon Lee, Sejong (KR)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/861,627

(22) Filed: Apr. 29, 2020

(65) Prior Publication Data

US 2021/0180611 A1 Jun. 17, 2021

(30) Foreign Application Priority Data

Dec. 12, 2019 (DE) ..... 10 2019 219 404.4

(51) Int. Cl.

*F04D 29/52* (2006.01)
*F04D 25/06* (2006.01)
*F04D 19/00* (2006.01)

(52) U.S. Cl.

CPC ..... *F04D 29/522* (2013.01); *F04D 19/002* (2013.01); *F04D 25/06* (2013.01); *F04D 29/526* (2013.01); *F05D 2240/14* (2013.01)

(58) Field of Classification Search

CPC ..... F04D 13/06; F04D 19/002; F04D 25/06; F04D 29/522; F04D 29/526; F05D 2240/14

See application file for complete search history.

(56) References Cited

U.S. PATENT DOCUMENTS 6,664,673 B2 * 12/2003 Lopatinsky ..... F04D 25/0653 257/E23.099
9,103,347 B2 * 8/2015 Yu ..... F04D 25/0633
2008/0225480 A1 * 9/2008 Kayama ..... F04D 29/526 361/695
2012/0275901 A1 * 11/2012 Durello ..... F01P 5/02 415/119
2012/0321474 A1 * 12/2012 Stevens ..... F04D 29/545 416/190
2013/0156571 A1 * 6/2013 Su ..... F04D 29/526 415/208.2

* cited by examiner

*Primary Examiner* — Philip E Stimpert
(74) *Attorney, Agent, or Firm* — Michael Best & Friedrich LLP

(57) ABSTRACT

A fan cowl (1) for receiving at least one fan (2) which is spaced apart relative to a cooler (4), having a fan frame (6) which can be attached to the cooler (4) with at least one cutout (8) for feeding air to an impeller (10) of the fan (2), the cutout (8) having a centered motor receptacle (12) for receiving a fan motor (14) which can be driven electrically, and the cutout (8) being surrounded on the circumferential side by a fan shroud (16). It is proposed that the fan shroud (16) has at least one opening (20) for setting an air pressure distribution which can be generated by way of the fan. A fan arrangement (22), having a fan cowl (1) of this type.

13 Claims, 4 Drawing Sheets

FAN COWL FOR THE REDUCTION OF OSCILLATIONS OF AN IMPELLER

BACKGROUND

The invention relates to a fan cowl for receiving at least one fan which is spaced apart relative to a cooler, having a fan frame which can be attached to the cooler with at least one cutout for feeding air to an impeller of the fan, the cutout having a centered motor receptacle for receiving a fan motor which can be driven electrically, and the cutout being surrounded on the circumferential side by a fan shroud. Furthermore, the invention relates to a fan arrangement with at least one fan which is arranged on a fan cowl.

Heat exchangers and coolers are used in different technical fields, in order to cool or to thermally regulate components by way of coolant circuits. In order to increase the cooling action, the heat exchangers or coolers are cooled by way of fans. A fan usually consists of a fan motor and a propeller or impeller which is driven by way of the fan motor.

During operation of the fan, noise and vibrations are also generated by way of the impeller in addition to the operating noise of the fan motor. The impeller of the fan causes oscillations, in particular, in a manner which is dependent on what is known as a blade pass frequency, which oscillations can be heard and perceived by the driver or by passengers. Oscillation stimulations of this type can impair the operation of the fan which is fastened to a heat exchanger, and can increase the operating noise of the fan beyond the noise level of the fan motor.

In the automotive field of use, high requirements are made of the noise emissions of operating components. A loud fan can disrupt the comfort, in particular, in the case of electric vehicles or in the case of hybrid vehicles.

SUMMARY

The object on which the invention is based can be considered that of proposing a fan cowl and an arrangement with a fan cowl of this type, which make a reduced roughness, in particular a reduced oscillation level, possible during fan operation.

In accordance with one aspect of the invention, a fan cowl for receiving at least one fan which is spaced apart relative to a cooler is provided. The fan cowl has a fan frame which can be attached to the cooler with at least one cutout for feeding air to an impeller of the fan. The cutout has a centered motor receptacle for receiving a fan motor which can be driven electrically. The fan can preferably consist of a fan motor and an impeller which is driven by way of the fan motor. The air which is fed via the cutout to the impeller can be accelerated by way of the impeller, and can be conveyed through the cooler. The cooler can be configured, for example, as a radiator or a flat tube cooler.

The cutout is surrounded on the circumferential side by a fan shroud, the fan shroud having at least one opening for setting an air pressure distribution which can be generated by way of the fan.

In accordance with a further aspect of the invention, a fan arrangement is provided. The fan arrangement has a fan cowl according to the invention. At least one fan with a fan motor and with an impeller which can be rotated by way of the fan motor is inserted into the fan cowl. The fan arrangement can preferably be fastened to a cooler, a cooling element, a radiator and the like. Here, the fan cowl can be oriented in a parallel or inclined manner relative to the cooler.

During operation of the fan, different types of oscillations and therefore also of sound waves are generated. Oscillation stimulations can be produced during operation in a manner which is dependent on the spacing of the impeller from the cooler and from the fan cowl, which oscillation stimulations have a disadvantageous effect on the durability and the operating noise of the fan arrangement.

Targeted control of the pressure distribution in the region of the impeller can be realized by way of the introduction of openings into the fan shroud. In particular, the control of a pressure distribution which results by way of the operation of the impeller can take place in the region of the radially end-side tips of the impeller by way of the introduction of at least one opening into the fan shroud.

In the region of the tips of the impeller, the at least one opening can make an additional air volumetric flow possible which changes a possible local resonance and oscillation behavior of the air between the cooler and the impeller and therefore leads to lower roughness and noise emissions during operation.

The pressure distribution of the air which can be generated by way of the operation of the impeller between the impeller and the cooler can preferably be controlled in a radially outer-side ring section by way of an introduction of openings.

In the case of one exemplary embodiment, the fan shroud is set up to cover an impeller of the fan at least in regions. The fan shroud can preferably cover tips of the impeller or at least one radially outer-side section of the impeller. As a result, an introduction of openings or holes into the fan shroud can make particularly effective control of the resulting pressure distribution of the impeller in the radial edge region possible.

In accordance with a further embodiment, the fan shroud has a V-shaped, L-shaped or U-shaped cross section which is open in the direction of a fan. In particular, the cross section of the fan shroud can be open in the direction of the impeller of the fan. By way of said measure, the fan shroud and the fan cowl can be produced in a particularly material-saving manner.

In accordance with one alternative refinement, the fan shroud can consist of a solid material, in the case of which its cross section is filled with material. In the case of a fan shroud of this type, the opening can extend through the entire cross section of the fan shroud and can therefore configure an air-conducting duct.

The fan cowl can be produced, for example, from a material which can be cast. For example, the fan cowl can consist of a plastic which can be injection molded or of a light metal. As an alternative or in addition, the fan cowl can be produced from a fiber composite material or can be reinforced by way of a fiber composite material.

In accordance with a further exemplary embodiment, the fan shroud has a shroud bottom and at least one shroud wall.

In the case of a further exemplary embodiment, the at least one opening is made in the shroud bottom and/or in the at least one shroud wall of the fan shroud. In particular, the fan shroud which is configured as a hollow profile can have a shroud bottom and at least one shroud wall which merge into one another in the form of a curve or at a right angle.

The shroud bottom can preferably run parallel to a surface which the rotating impeller sweeps over during operation. Here, the at least one shroud wall can run obliquely or perpendicularly with respect to the shroud bottom.

The cutout can preferably have a circular shape which has substantially an extent in accordance with an extent of the impeller.

Flexible control of the pressure distribution can be realized depending on the arrangement of the at least one opening in the shroud wall or in the shroud bottom. In particular, installation spaces of different configuration at the fan arrangement can be utilized in an optimum manner by way of said measure.

In accordance with a further embodiment, the at least one opening is of square, cuboid, oval or circular configuration. As a result, additional control of the additionally provided air volume can be implemented. In particular, a shape of the opening which is adapted in a manner which is dependent on the production method of the fan cowl can be selected, in order to simplify the manufacturing method and demolding of the fan cowl.

In accordance with a further exemplary embodiment, the fan shroud has a plurality of openings, the openings being distributed homogeneously or inhomogeneously over a circumference of the fan shroud. For example, a distribution of the openings along the fan shroud, which distribution is selected in a manner which is dependent on the embodiment of the cooler, can be implemented by way of said measure. Here, local fluctuations in the resulting dynamic pressure or air pressure which the impeller generates during operation can be equalized.

In accordance with a further embodiment, the openings are distributed homogeneously or inhomogeneously along a circumferential section, in particular along a circumferential half, of the fan shroud. The openings can be arranged distributed, for example, along an upper circumferential half or a lower circumferential half of the fan shroud. For example, the openings can be distributed symmetrically or asymmetrically on the circumferential section.

The pressure distribution of the air between the impeller and the cooler during operation of the fan is dependent, in particular, on an axial spacing between the impeller and the cooler. Depending on the embodiment of the fan arrangement, the cooler and/or the fan can be inclined, in order to achieve an optimized incident air flow. As a result, the spacing of the impeller from the cooler can be increased on one circumferential half, without additional oscillations being caused.

As a result of the introduction of openings on one half of the air shroud, on which the spacing between the impeller and the cooler is increased, an equalization of the pressure distribution can be achieved. Said measure makes a reduced roughness and noise emissions during operation of the impeller or the propeller of the fan possible.

BRIEF DESCRIPTION OF THE DRAWINGS

In the following text, preferred exemplary embodiments of the invention will be described in greater detail on the basis of greatly simplified diagrammatic illustrations. In the drawing.

DETAILED DESCRIPTION

Figure 1:
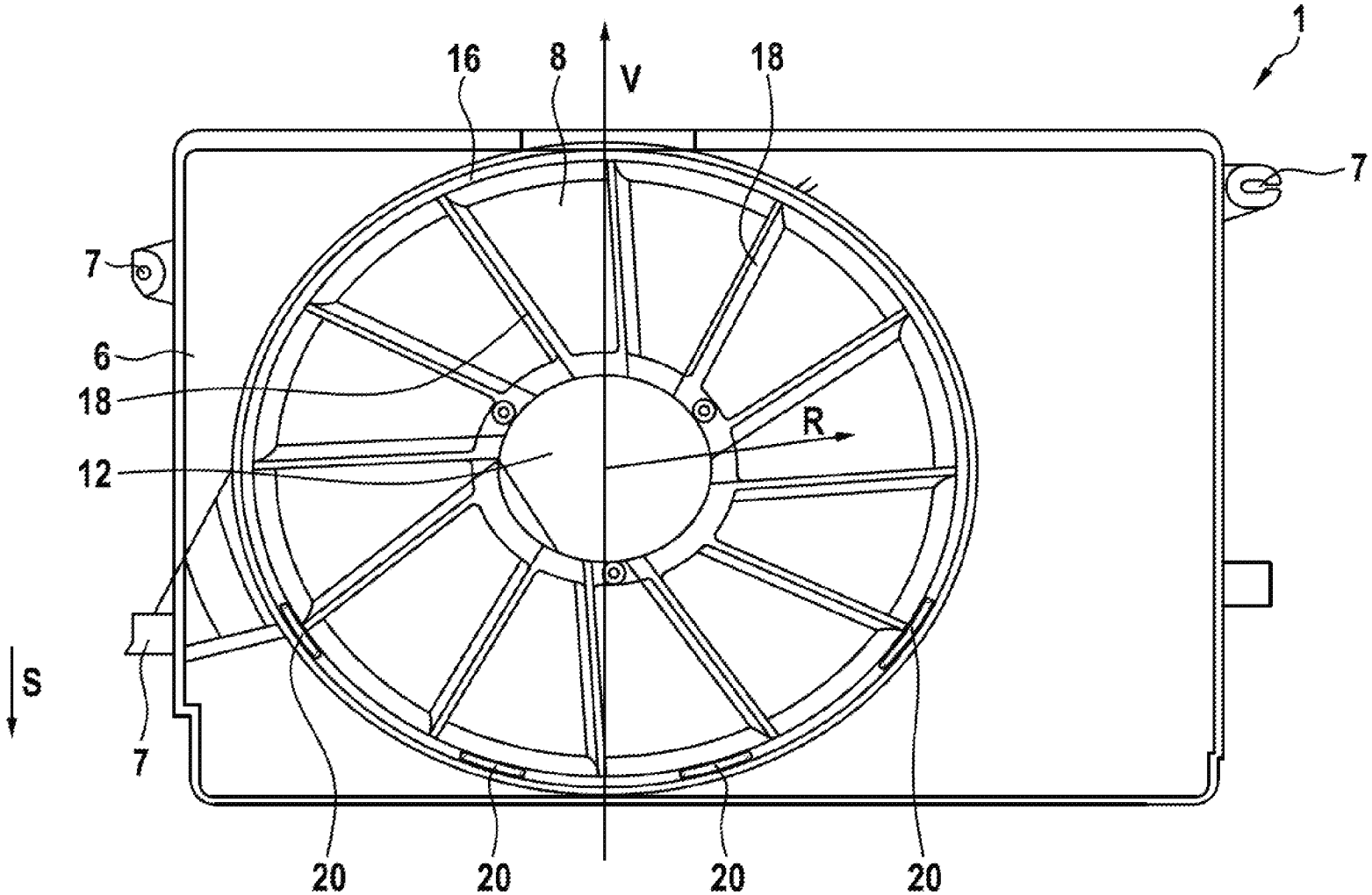
FIG. 1 shows a diagrammatic illustration of a fan cowl in accordance with one embodiment.
Figure 2:
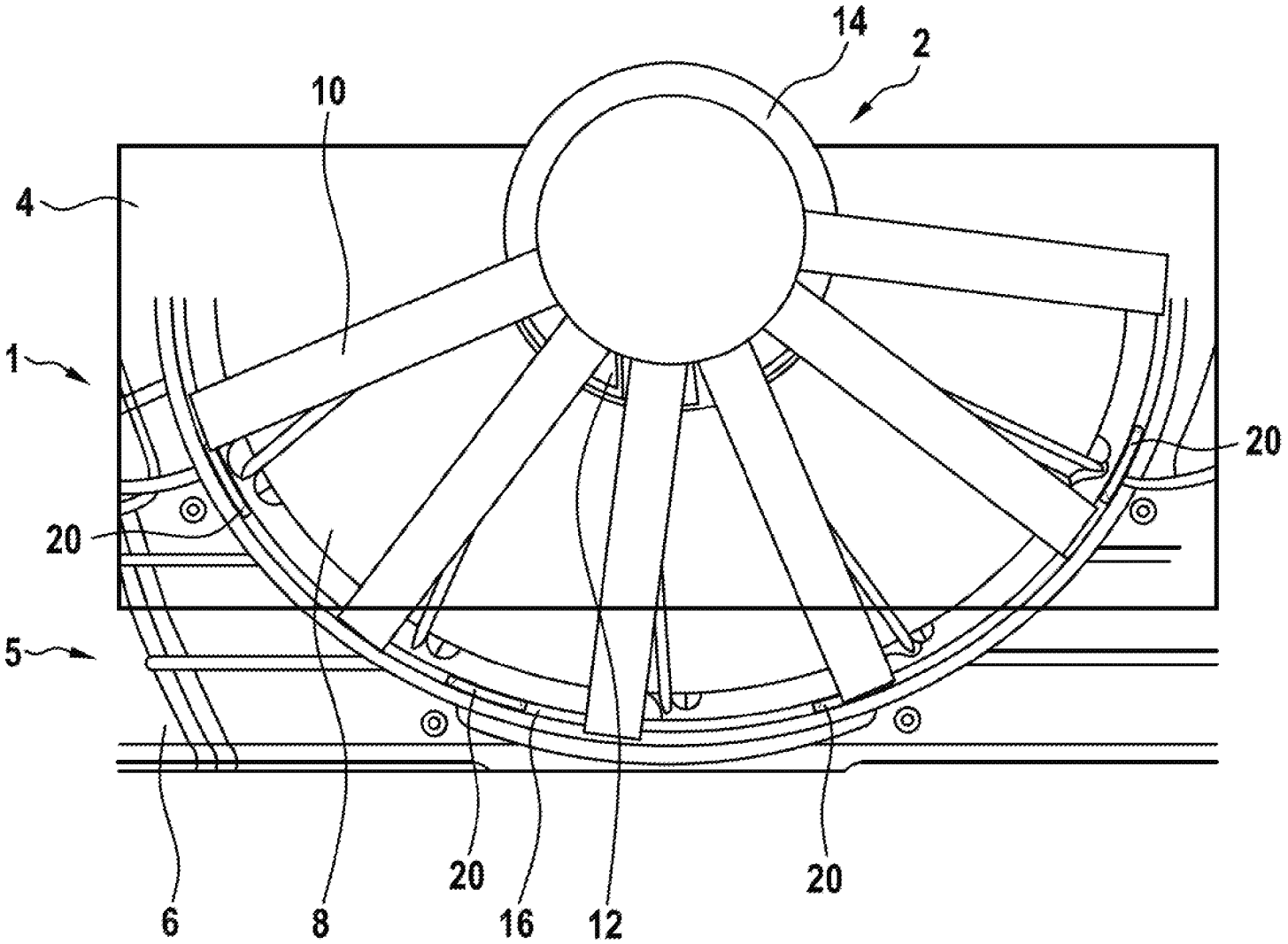
FIG. 2 shows a detailed view of a fan arrangement with the fan cowl from FIG. 1.

FIG. 1 shows a diagrammatic illustration of a fan cowl 1 in accordance with one embodiment. The fan cowl 1 serves for arranging at least one fan 2 relative to a cooler 4, which are shown in FIG. 2.

The fan cowl 1 has a fan frame 6 which can be attached to the cooler 4 with at least one cutout 8 for feeding air to an impeller 10 (shown in FIG. 2) of the fan 2.

The fan frame 6 is of substantially rectangular form and surrounds the cutout 8. The fan frame 6 can have a form and extent in accordance with a form and extent of the cooler 4.

The fan cowl 1 can be fastened to the cooler 4 or directly to a surround of the cooler 4 at fastening points 7 which extend from the fan frame 6. For example, the fan cowl 1 can be fixed by way of screws at the fastening points 7.

The cutout 8 has a centered motor receptacle 12 for receiving a fan motor 14 which can be driven electrically.

The cutout 8 is surrounded on the circumferential side by a fan shroud 16. The fan shroud 16 is of annular configuration and delimits the cutout 8 in the radial direction R along the entire circumference of the cutout 8.

The motor receptacle 12 is arranged in the cutout 8 in a centered manner via struts 18. The struts 18 extend from the fan frame 6 or from the fan shroud 16.

Openings 20 are made in the fan shroud 16, which openings 20 extend through the fan cowl 1 or the fan shroud 16 parallel to the cutout 8.

In the exemplary embodiment which is shown, four openings 20 are configured on a lower circumferential half (in the direction of gravity S) of the fan shroud 16, in order to act on an air pressure distribution which can be generated by way of the fan 2. The lower circumferential half of the fan shroud 16 is illustrated in detail in FIG. 2.

The openings 20 can be, for example, round, oval, square, rectangular and the like in shape. For example, the openings 20 can have a circumferential width or dimension in an order of magnitude of from 0.1 to 20 cm inclusive. Here, one opening 20 or a plurality of openings 20 can be made in the fan shroud 16.

The openings 20 establish an air-conducting connection between the two flat sides of the fan cowl 1, and make a local increase of the air volume which is available to the fan 2 possible.

FIG. 2 shows a detailed view of a fan arrangement 22 with the fan cowl 1 from FIG. 1. The fan arrangement 22 has a fan cowl 1, a fan motor 14 which is fastened in the motor receptacle 12, and an impeller 10 which can be driven by way of the fan motor 14.

The impeller 10 has a plurality of blades which suck in the air via the cutout 8 during operation of the fan motor 14 and can accelerate in the direction of the cooler 4. In the exemplary embodiment which is shown, the fan 2 with the fan motor 14 and the impeller 10 is situated behind the fan cowl 1 and in front of the cooler 4.

In the exemplary embodiment which is shown, four openings 20 are made in the fan shroud 16. The openings 20 are positioned in a mirror-symmetrical manner along a vertically running symmetry axis V.

Depending on the configuration, for example, two, six, eight or more openings 20 can also be arranged along a circumferential half or along a circumferential section of the fan shroud 16.

The fan shroud 16 has openings 10 which are arranged, for example, only on the lower circumferential half, because a cooler or radiator 4 is covered by way of the fan 2 only in regions. On a lower section 5, the cooler 4 can have an offset with respect to an air conditioning condenser or intercooler which is arranged in parallel. There is therefore a greater axial spacing between the impeller 10 and a surface to be cooled in the region of the lower section 5, which can cause increased volume and roughness.

Figure 3:
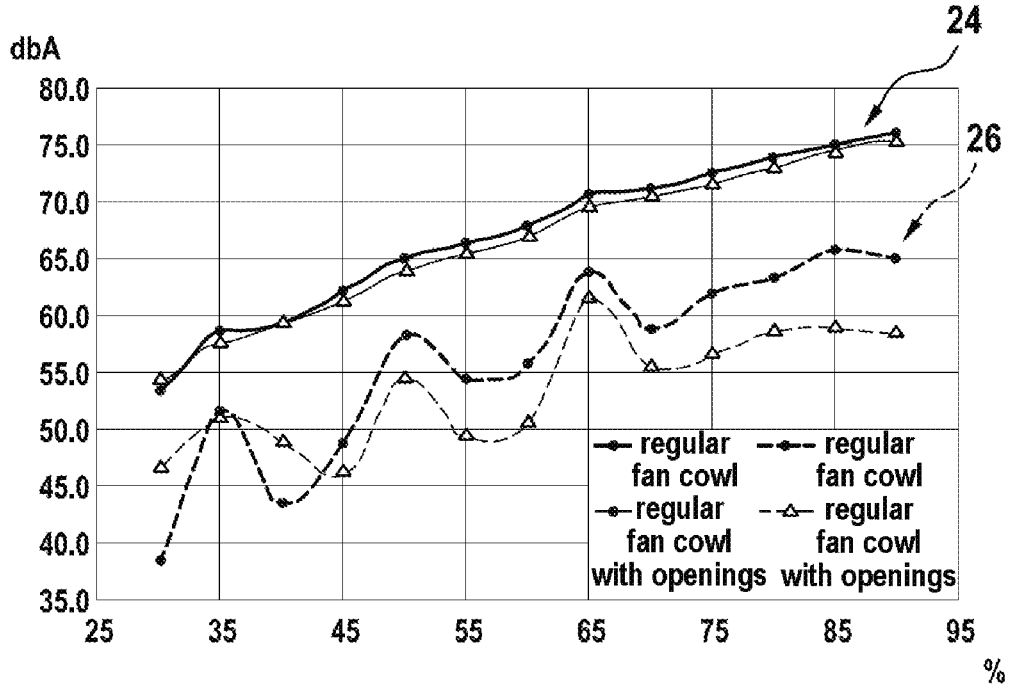
FIG. 3 shows a diagram for illustrating noise levels of a fan arrangement with the fan cowl which is shown in FIG. 1, with measured data which are determined in a test bench experiment.

FIG. 3 shows a diagram for illustrating noise levels of a fan arrangement 22. The fan arrangement 22 has a fan cowl 1 which is shown in FIG. 1. The measured data which can be seen in the diagram were determined in a test bench experiment. The diagram shows a noise level in dBA and a set power output of the fan motor 14 in percent. The diagram shows a comparison between a regular fan cowl and a fan cowl 1 with openings 20 which are made in the fan shroud 16.

Two measuring sequences 24, 26 are shown which illustrate operating noise 24 of the fan motor 14 and operating noise 26 of the impeller 10, in particular operating noise 26 which is caused by way of the blade pass frequency, in the case of a different power output of the fan motor 14.

Figure 4:
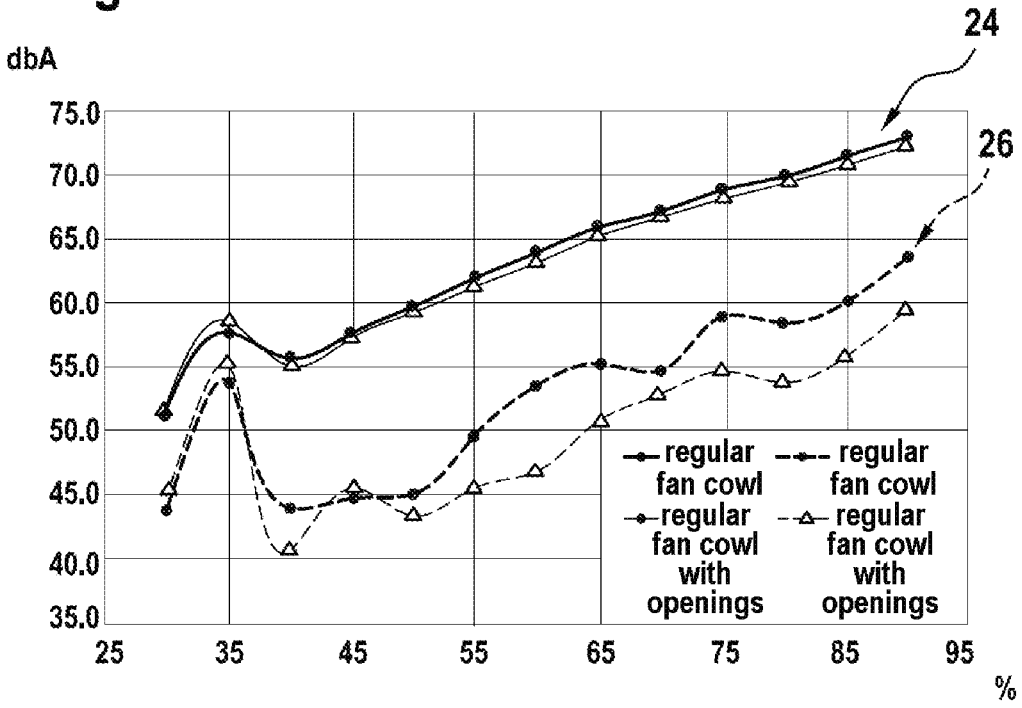
FIG. 4 shows a diagram for illustrating noise levels of a fan arrangement with the fan cowl which is shown in FIG. 1, with measured data which are determined in a surrounding area of the vehicle.

FIG. 4 shows a diagram for illustrating noise levels of a fan arrangement 22 with the fan cowl 1 which is shown in FIG. 1. The measured data were determined in a vehicle surrounding area. Here, in an analogous manner with respect to FIG. 3, operating noise 24 of the fan motor 14 and operating noise 26 of the impeller 10 are shown.

In contrast to the diagram which is shown in FIG. 3, the measured data were measured in a field test in a surrounding area of the vehicle and in an installed state of the fan arrangement 22.

As can be seen in FIG. 3 and FIG. 4, a considerable reduction of the operating noise 26 of the impeller 10 results by way of the openings 20, in particular in the case of relatively high power outputs of the fan motor 14.

Figure 5:
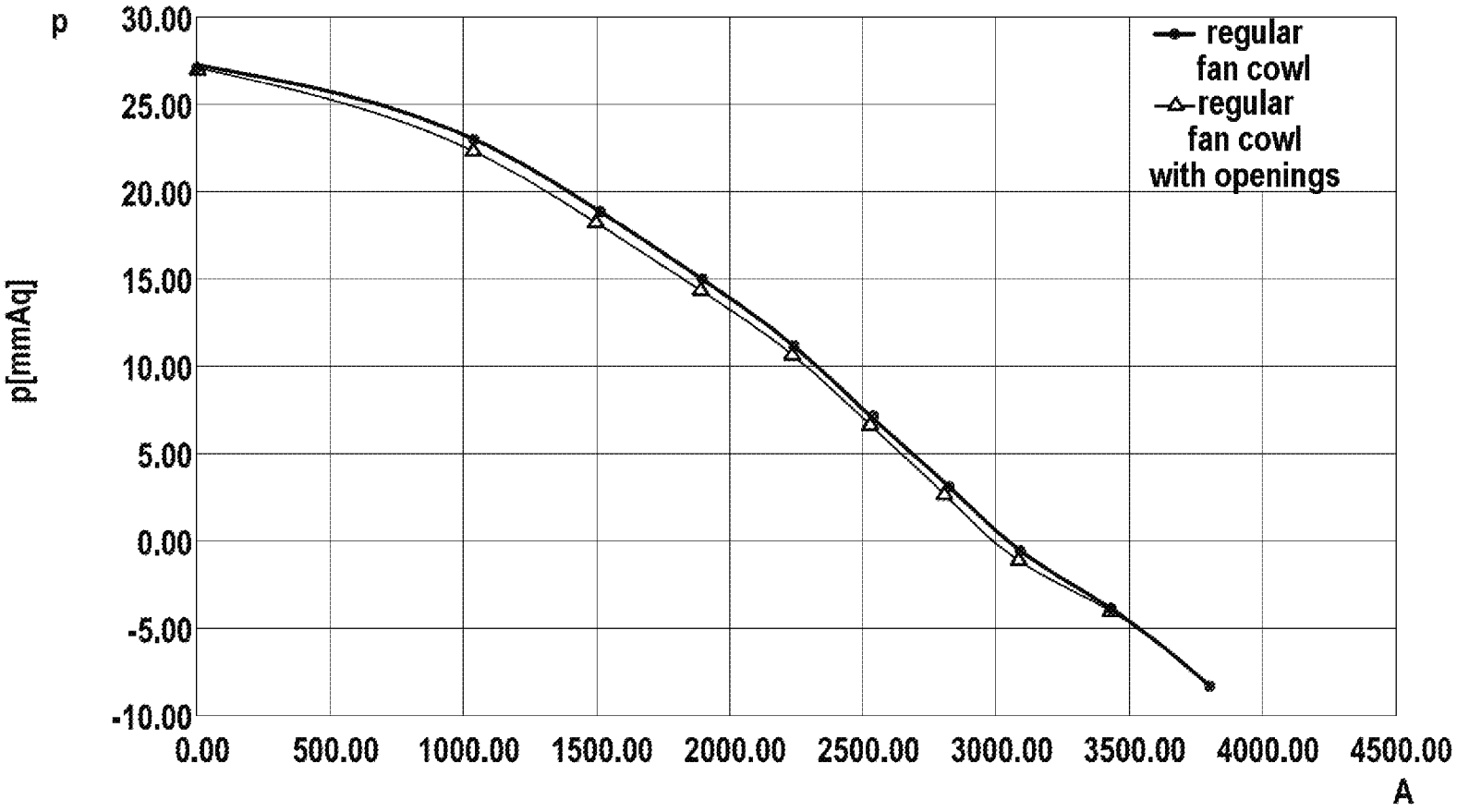
FIG. 5 shows a diagram for illustrating an operational performance of a fan arrangement with a fan cowl from FIG. 1.

FIG. 5 shows a diagram for illustrating an operational performance of a fan arrangement 22 with a fan cowl 1 from FIG. 1. Here, a static pressure p is shown in mmAq, and the air mass throughput A is shown in cubic meters per hour.

It can be seen from the diagram that the use of the openings 20 has substantially no effects on the air mass throughput A or the generated pressure p of the fan 2.

The invention claimed is:

1. A fan cowl (1) for receiving at least one fan (2), the fan cowl (1) having a fan frame (6) with at least one cutout (8) for feeding air to an impeller (10) of the fan (2), the cutout (8) having a centered motor receptacle (12) for receiving a fan motor (14) which is configured to be driven electrically, and the cutout (8) being surrounded on the circumferential side by a fan shroud (16), characterized in that the fan shroud (16) has at least one opening (20) for setting an air pressure distribution which is configured to be generated by way of the fan, wherein the fan shroud (16) has a shroud bottom and at least one shroud wall which merge into one another in the form of a curve or at a right angle, and the at least one opening (20) is made in the shroud bottom and/or in the at least one shroud wall of the fan shroud (16), wherein the at least one opening (20) is oriented in the fan shroud (16) such that air passes through the at least one opening in the fan shroud (16), and thereby through the fan shroud (16), in an axial direction, wherein the shroud wall defines an outermost perimeter, and wherein the at least one opening (20) is at least partially disposed radially within the outermost perimeter.

2. The fan cowl according to claim 1, the fan shroud (16) configured to cover the impeller (10) of the fan (2) at least in regions.

3. The fan cowl according to claim 1, the fan shroud (16) having a V-shaped, L-shaped or U-shaped cross section which is open in a direction of the fan (2).

4. The fan cowl according to claim 1, the at least one opening (20) being of rectangular, square, cuboid, oval or circular configuration.

5. The fan cowl according to claim 1, the fan shroud (16) having a plurality of openings (20), the openings (20) being distributed over a circumference of the fan shroud (16).

6. The fan cowl according to claim 1, the fan shroud (16) having a plurality of openings (20), the openings (20) being distributed along a circumferential section of the fan shroud (16).

7. The fan cowl according to claim 6, the openings (20) being distributed along a circumferential half of the fan shroud (16).

8. A fan arrangement (22), having a fan cowl (1) according to claim 1 and having at least one fan (2) which is inserted into the fan cowl (1) with a fan motor (14) and with an impeller (10) which is configured to be driven by way of the fan motor (14).

9. The fan arrangement (22) according to claim 8, wherein the at least one opening (20) is intermittently covered by the impeller (10) of the fan (2) during rotation of the impeller (10).

10. A fan arrangement (22), having a fan cowl (1) according to claim 1 and having an impeller (10) which is inserted into the fan cowl (1), wherein the at least one opening (20) is positioned such that the at least one opening (20) is intermittently covered in the axial direction by the impeller (10) during rotation of the impeller (10).

11. The fan cowl according to claim 1, the fan shroud (16) having a plurality of openings (20), the openings (20) being distributed along only a first circumferential half of the fan shroud (16) and not being distributed along a second circumferential half of the fan shroud (16).

12. The fan cowl according to claim 1, wherein the at least one opening (20) is radially adjacent the shroud wall.

13. The fan cowl according to claim 1, wherein the at least one opening (20) is in the shroud bottom and is radially adjacent the shroud wall.

* * * * *